US006036133A

United States Patent [19]

Milligan

[11] Patent Number: 6,036,133

[45] Date of Patent: Mar. 14, 2000

[54] RECOILING STRING LINE APPARATUS

[76] Inventor: Patrick Kevin Milligan, P.O. Box 1173, Cashiers, N.C. 28717

[21] Appl. No.: 09/135,443

[22] Filed: Aug. 17, 1998

[51] Int. Cl.[7] ..... B65H 75/48; B43L 13/00; G01B 3/10

[52] U.S. Cl. ..... 242/378.4; 33/408; 33/409; 33/759

[58] Field of Search ..... 242/378.4, 379; 33/407, 408, 409, 410, 413, 756, 759, 760, 769

[56] References Cited

U.S. PATENT DOCUMENTS

| | | | |
|---|---|---|---|
| 1,124,310 | 1/1915 | Harris | 33/408 |
| 1,594,836 | 8/1926 | Ingram | 33/408 |
| 2,647,321 | 8/1953 | Hart et al. | 33/409 |
| 2,665,487 | 1/1954 | Mastrella | 33/408 |
| 2,800,719 | 7/1957 | Tuzicka | 33/409 |
| 3,122,836 | 3/1964 | Aciego . | |
| 4,084,321 | 4/1978 | Huston . | |
| 4,197,656 | 4/1980 | Lane et al. . | |
| 4,470,200 | 9/1984 | Scarano | 33/408 |
| 4,561,189 | 12/1985 | Hirneise . | |
| 4,662,078 | 5/1987 | Gammon et al. . | |
| 5,125,162 | 6/1992 | Prebeck . | |
| 5,479,713 | 1/1996 | Wood | 33/407 |

FOREIGN PATENT DOCUMENTS

| | | | |
|---|---|---|---|
| 2414714 | 9/1979 | France | 33/409 |
| 2241015 | 8/1991 | United Kingdom | 33/409 |

*Primary Examiner*—Donald P. Walsh
*Assistant Examiner*—William A. Rivera
*Attorney, Agent, or Firm*—Michael I. Kroll

[57] ABSTRACT

An apparatus (11) for aligning and positioning a mason's string (13) is provided which comprises a pair of line blocks (11). A housing (15) for the line blocks (11) is provided containing a spring-loaded (29) reel assembly (25) around which the string (13) is coiled. The reel assemblies (25) of each line blocks (11) cooperate with each other to tension the string (13) and hold the line block (11) in place on the workpiece (21) upon which the device (11) is attached. In an alternative embodiment, a weight (43) is placed on or about the housing (15) to assist in attaching the apparatus (11) to the workpiece (21).

13 Claims, 8 Drawing Sheets

RECOILING STRING LINE APPARATUS

BACKGROUND OF THE INVENTION

Field of the Invention

The present invention relates generally to construction string lines and, more specifically, to a construction string line apparatus with recoiling capabilities which provides a string line take-up and storage means, and which is self-winding and has a locking offset mechanism.

Description of the Prior Art

Numerous string line devices have been provided in the prior art. While these units may be suitable for the particular purposes for which they address, they would not be suitable for the purposes of the present invention as heretofore described.

Some of the prior art devices were used for applying a chalk line as used in construction and carpentry work and were concerned with a line or string holding device for facilitating the application of a chalk line of relatively long length. In conventional practice, to apply a long chalk line to a surface, two workmen hold opposite ends of a chalking string, line, or cord which was coated with chalk. With the line held taut, one of the workmen pulled his end of the string away from the surface and allowed it to snap back. This action produced a line of chalk which could be used as a base line or reference point for further work. When a line was to be marked on a straight surface, one end of the string could be held by a heavy object if the surface was horizontal or a nail or other pointed instrument could be driven into the workpiece and used to hold one end of the line. While some of these methods were workable, they were cumbersome and makeshift at best They would not work where it was undesirable to mark or damage the surface. Where the chalk line was to be formed on a horizontal, level surface, such as a floor, a heavy object such a paint bucket or the like could be employed to hold down one end of the line, but there was the problem of slippage of the object.

Some of the prior art devices also were used to properly align and position a plurality of bricks or blocks as they were being placed on each other to build, for example, a brick or block wall. When a wall extended for a relatively long distance it could be difficult to ensure that the forward faces of each brick or block were properly positioned relative to each other. Also, it was difficult to assure that each brick or block was properly positioned in the vertical plane relative to each other.

ACIEGO, A. C.

LINE HOLDING DEVICE

U.S. Pat. No. 3,122,836

Aciego described a line holding device used for forming chalk lines or similar taut lines for providing long reference boundaries. Aciego provided a metallic block member having means such as prongs for attachment to the stationary surface upon which the chalk line was to be formed. The line itself was adapted to pass underneath the block member. However, Aciego provided no line take-up or storage means and was not easily mountable on the block or brick.

PREBECK, ALFREDO

BRICK ALIGNMENT CLIPS

U.S. Pat. No. 5,125,162

Prebeck described a line holding device which was alternatively clipped or attached to the face of a brick using a thumb screw for providing a long reference boundary. A line extended between adjacent clips to align a plurality of bricks. The device had irregular toothed surfaces which were drawn into the laterally outward face of the brick to secure the clip on the brick. However, Prebeck provided no line take-up or storage means.

HIRNEISE, PAUL J.

CHALKING LINE HOLDER

U.S. Pat. No. 4,561,189

Hirneise described a line holding device for use in stretching and striking a chalk line. The holder comprised a toe plate, a tubular member and a retainer plate integrally formed with each other and a center shaft inside the tubular member wherein the parts cooperated to hold the assister on various configurations of workpieces. The device was simple but could not be mounted on all surfaces without driving a nail or a pin to secure it. Further, Hirneise provided no line take-up or storage means.

HUSTON, CHARLES W.

MASON'S GUIDE

U.S. Pat. No. 4,084,321

Huston described a mason's guide for anchoring and positioning an alignment cord. The guide had a clamp element having a pair of adjustable fingers attached thereto, the fingers being designed to affix the guide temporarily to any one of a variety of masonry building units. The device had a slidably mounted thumb screw mechanism for attachment to masonry blocks. However, Huston provided no line take-up or storage means.

GAMMON, NORMAN P., ET AL.

CONSTRUCTION STRING REEL

U.S. Pat. No. 4,662,078

Gammon, et al. described a reel assembly for holding cords or lines which was equipped with a resilient member for retrieving the line. The resilient member that retrieved the plumb line or string was entirely enclosed in the spool assembly that was contained within the housing of the reel assembly. However, Gammon et al., was little more than a takeup reel and was not adapted for use in the masonry industry nor was it attachable to masonry building materials such as bricks or blocks.

LANE, DEREK, ET AL.

CHALK LINE DISPENSER

U.S. Pat. No. 4,197,656

Lane, et al., described a chalk line dispenser similar to Gammon, et al., comprising a reel assembly for holding cords which was equipped with a coil spring powered take-up reel for retrieving the line. The drive casing included a shaft and a drive take-up with a thumb operated lever for releasing a clutch to enable spring reeling of the line. However, Lane, et al., just as Gammon, et al., provided merely a spring loaded take-up reel and was not provided with means for attachment to masonry building materials such as bricks or blocks.

Consequently, as a review of the prior art demonstrates, a need exists for improvements in construction string line devices which will overcome the weaknesses of the prior art by providing line take-up and storage means, have recoiling capabilities, and be easily mountable on masonry bricks and blocks.

SUMMARY OF THE PRESENT INVENTION

The recoiling string line apparatus of the present invention consists of two spring loaded line blocks connected by heavy duty masonry string. Each line block is located in a box-like housing having a top portion that extends beyond the front face of the reel housing forming a flange that rests on and easily mounts on the top of the cornerstone of the structure being built. The line blocks are placed on two opposing cornerstones and the string line is set just above and flush to the top edge of the structure being built. The line block of the present invention is also equipped with a line offset mechanism to ensure that the line is located out of the way of the brick mason. The mason can then use the string line as a guide to ensure that the bricks or cinder blocks being installed are plumb and level.

A primary object of the present invention is to provide a string line apparatus with recoiling capabilities which will overcome the shortcomings of prior art devices.

Another object of the present invention is to provide a string line apparatus having line recoiling capabilities that is easy to set up, take down, and store without the string getting tangled.

Yet another object of the present invention is to provide a string line apparatus with recoiling capabilities that has a spring-loaded reel assembly to automatically spool the string into a contained reel housing when tension is released from the other end of the string.

A yet further object of the present invention is to provide a string line device with recoiling capabilities that holds the line blocks in place by utilizing the opposing tension of two spring assemblies being drawn together.

A still further object of the present invention is to provide a slidable means for adjusting the placement of the string as it passes through an elongated aperture on the vertical wall of the flange facing the other line block.

A still further object of the present invention is to provide string line apparatus that is economical in cost to manufacture.

Additional objects of the present invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described and yet remain within the scope of the appended claims.

BRIEF DESCRIPTION OF THE DRAWINGS

Various other objects, features and attendant advantages of the present invention will become more fully appreciated as the same becomes better understood when considered in conjunction with the accompanying drawings, in which like reference characters designate the same or similar parts throughout the several views.

DESCRIPTION OF THE REFERENCE NUMERALS

Figure 1:
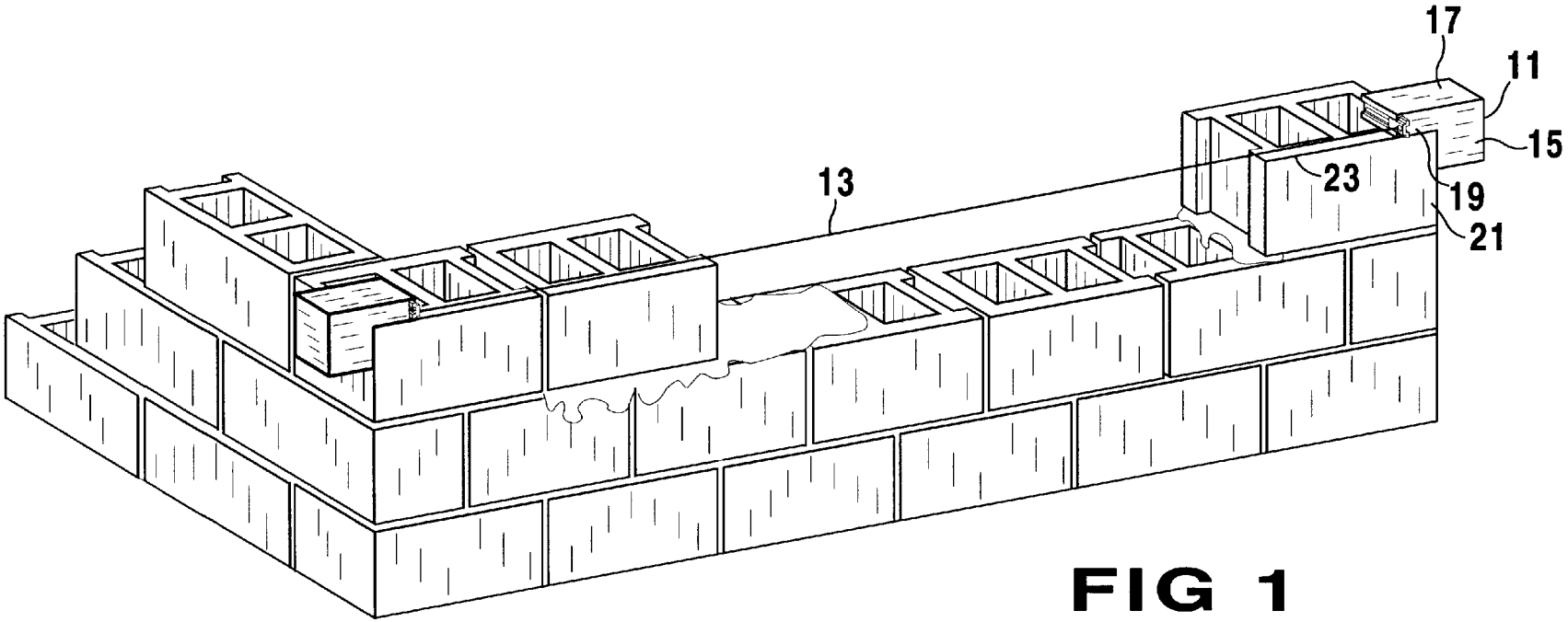
FIG. 1 is a perspective view of one embodiment of the present invention shown in operative connection.

Turning now descriptively to the drawings, in which similar reference characters denote similar elements throughout the similar views, the Figures illustrate the composition and structure of the present invention. With regard to the reference numerals used, the following numbering is used throughout the various drawing figures.

11 line block
13 string
15 box like housing
17 top portion of housing
19 flange
21 cornerstone or workpiece
23 structure being built
25 spool
27 axle
29 spring
31 line offset mechanism
33 line offset bar
35 line hole in line offset bar
37 track for bar
39 elongated hole
41 vertically shortened front wall
43 weighting means

DETAILED DESCRIPTION OF THE PREFERRED EMBODIMENT(S)

FIG. 1 is a perspective view of the present invention as shown in use for aligning and positioning a masons string during construction of a cinder block wall. The recoiling string line apparatus consists of two line blocks 11 that face each other and are connected by heavy duty masonry string 13. Each line block has a box-like portion 15 to house a reel assembly (not shown) and a top portion 17 that extends beyond the forward facing side of the reel housing forming an overhang or flange 19 that rests on top of the cornerstone 21 of the structure being built. The line blocks are placed on two opposing cornerstones 21 and the string line 13 is set just above and flush to the top edge 23 of the structure being built. The mason can then use the string line 13 as a guide to ensure that the bricks or cinder blocks being installed are plumb and level.

Figure 2:
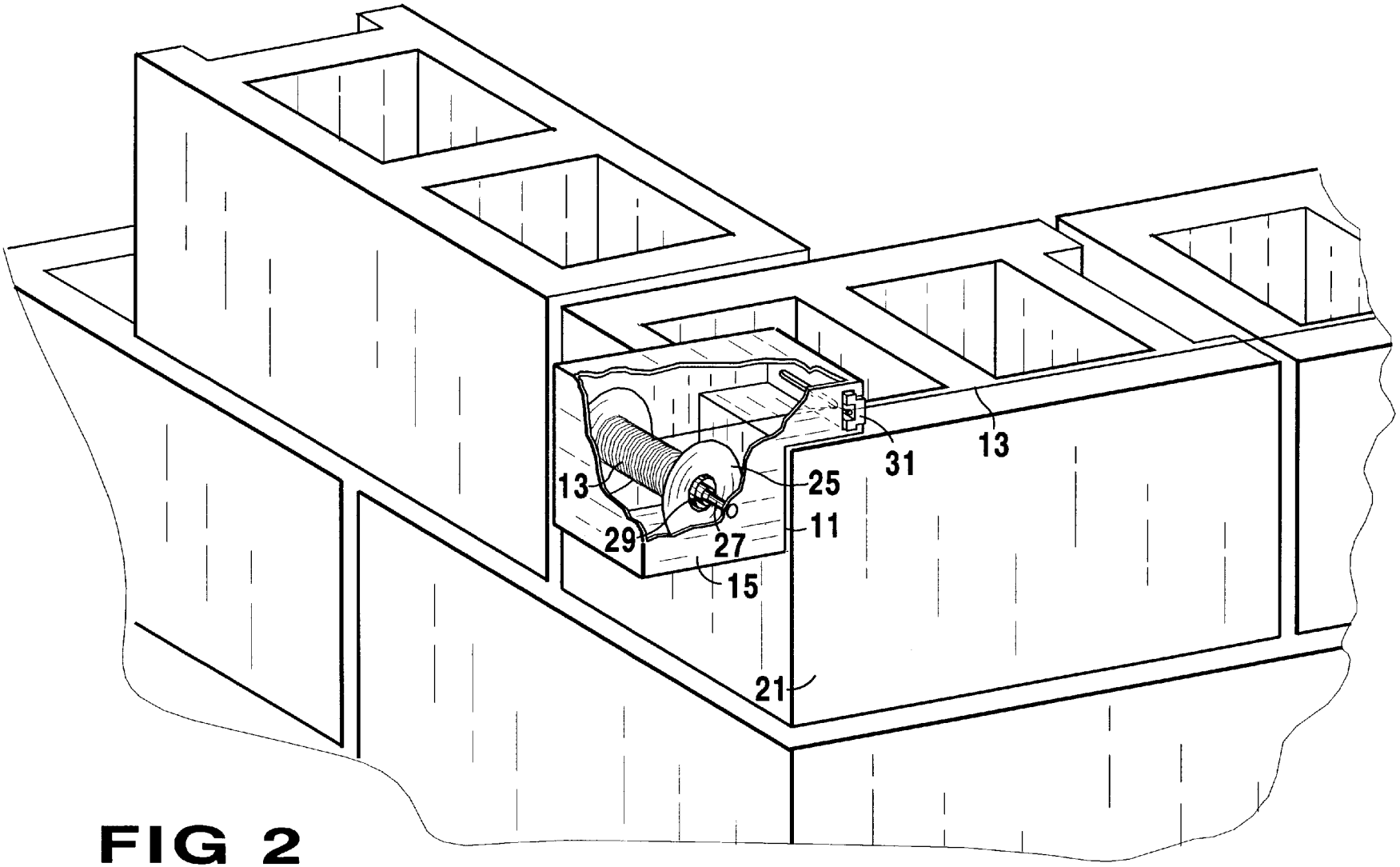
FIG. 2 is a perspective of one embodiment of the present invention showing a partial cross-section view and is taken from FIG. 1.

FIG. 2 is a perspective view, taken from FIG. 1 as indicated, showing a partial cross-section of the housing 15 with parts broken away showing the spool 25 upon which the line 13 is wound and the reel or axle assembly 27 with connecting tension spring 29 for tensioning and recoiling or rewinding the axle assembly 27. The springs 29 of the two line blocks 11 cooperate with each other to provide opposing tension to hold the reel housings 15 tight to the vertical walls or cornerstones 21 of the structure or workpiece. A line offset mechanism 31 is used to adjust the string line 13 according to the placement of the line blocks 11 in relation to the structure.

Figure 3:
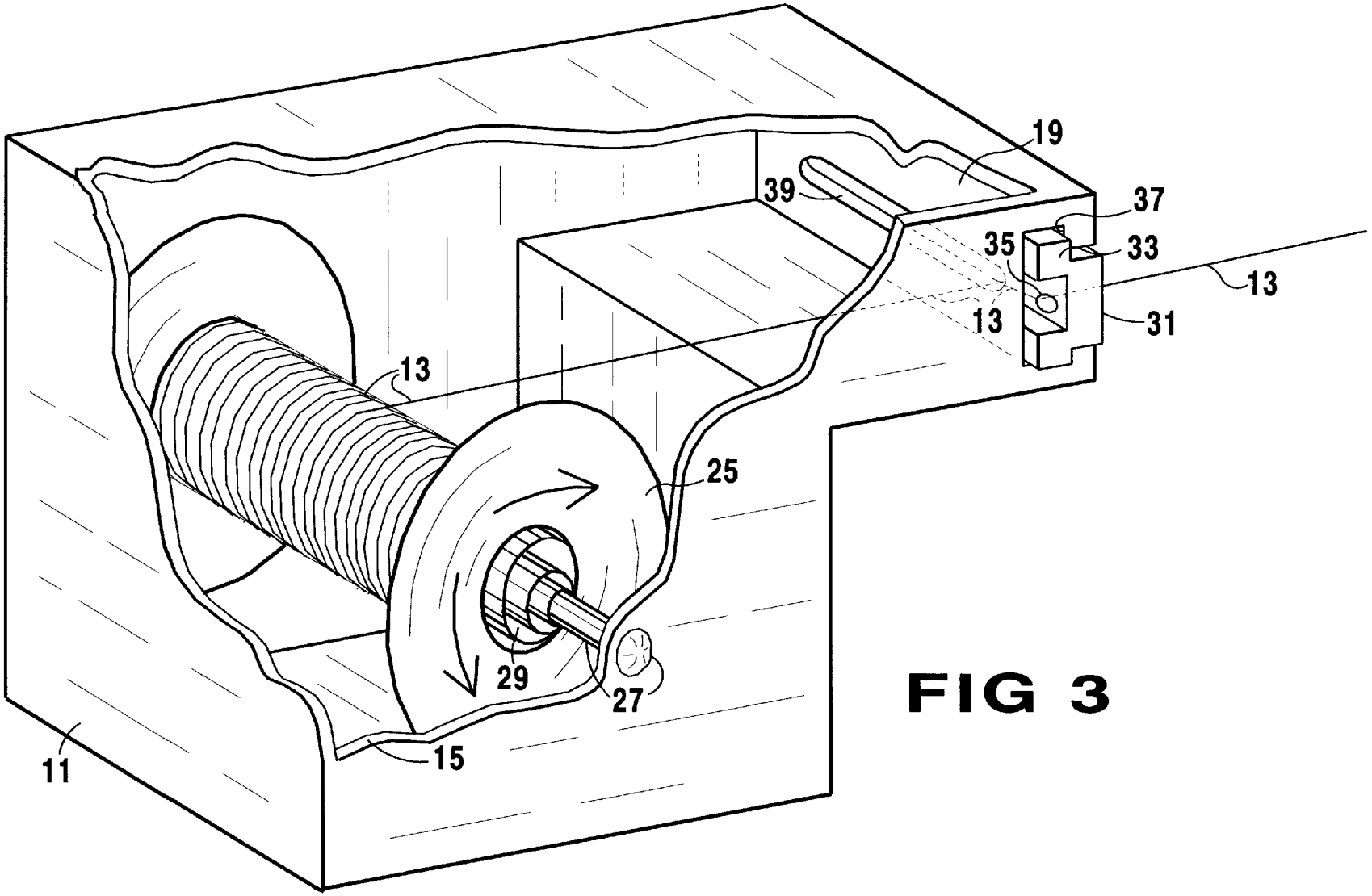
FIG. 3 is a perspective of one embodiment of the present invention showing an enlarged cross-section view.

FIG. 3 is an enlarged cross-section perspective view of the present invention shown similarly as in FIG. 2 showing the housing 15 with parts broken away showing the spool 25 upon which the line 13 is wound and the rotable reel or axle assembly 27 with connecting tension spring 29 for tensioning and recoiling or rewinding the axle assembly 27. The springs 29 of the two line blocks 11 provide opposing tension to hold the reel housings 15 tight to the vertical walls or cornerstones 21 (not shown) of the structure. A slidably adjustable line offset mechanism 31 is used to adjust, locate or align the string line 13 according to the placement of the line blocks 11 in relation to the structure. The line offset mechanism 31 consists of a horizontally slidable bar 33 having a hole 35 therein through which the line 13 can pass. The slidable bar 33 operates and slides in a track or slot 37 located on the forward facing overhang 19 of the housing 15. Also shown is the forward facing overhang 19 having a horizontally elongated hole 39 wherein the elongated hole 39 extends almost completely across the width of the forward facing overhang 19. Further, therein is shown the vertically shortened front wall 41 of the housing 15 which cooperates with the overhang 19 to form a flange for attachment to the workpiece 21.

Figure 4:
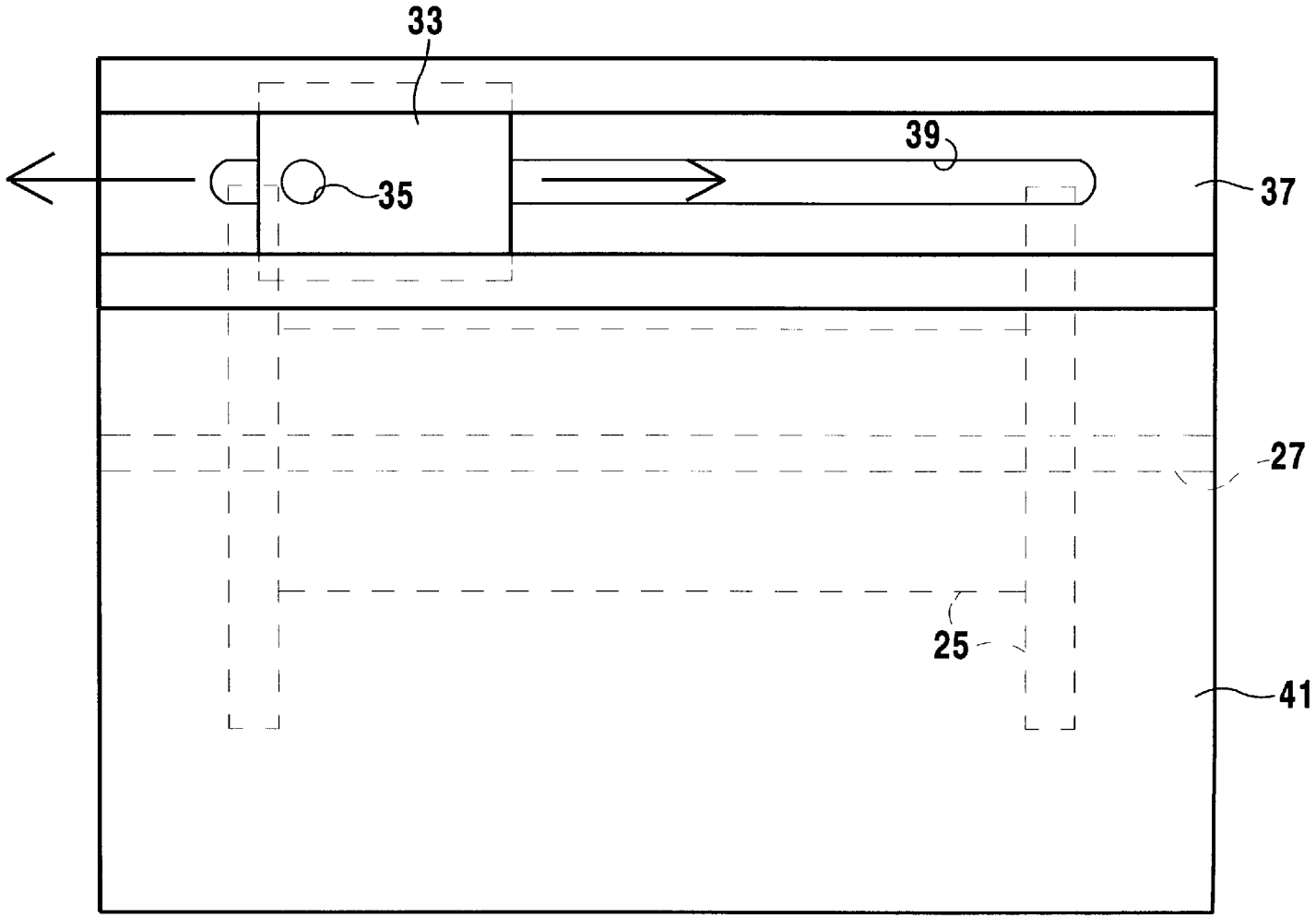
FIG. 4 is a front elevation of the present invention showing the action of the slidable offset mechanism.

FIG. 4 is a front elevation of the present invention showing the action of the slidable string offset mechanism whereby the string is offset out of the mason's path of work. Therein is shown the horizontally slidable bar 33 having a hole 35 therein along with the track 37 in which the bar 33 is mounted and slides. Also, therein is shown the horizontally elongated hole 39 which provides a passageway through which the line 13 (not shown) can pass, along with the vertically shortened front wall 41. Also shown as hidden lines are the spool assembly 25 and the axle assembly 27.

Figure 5:
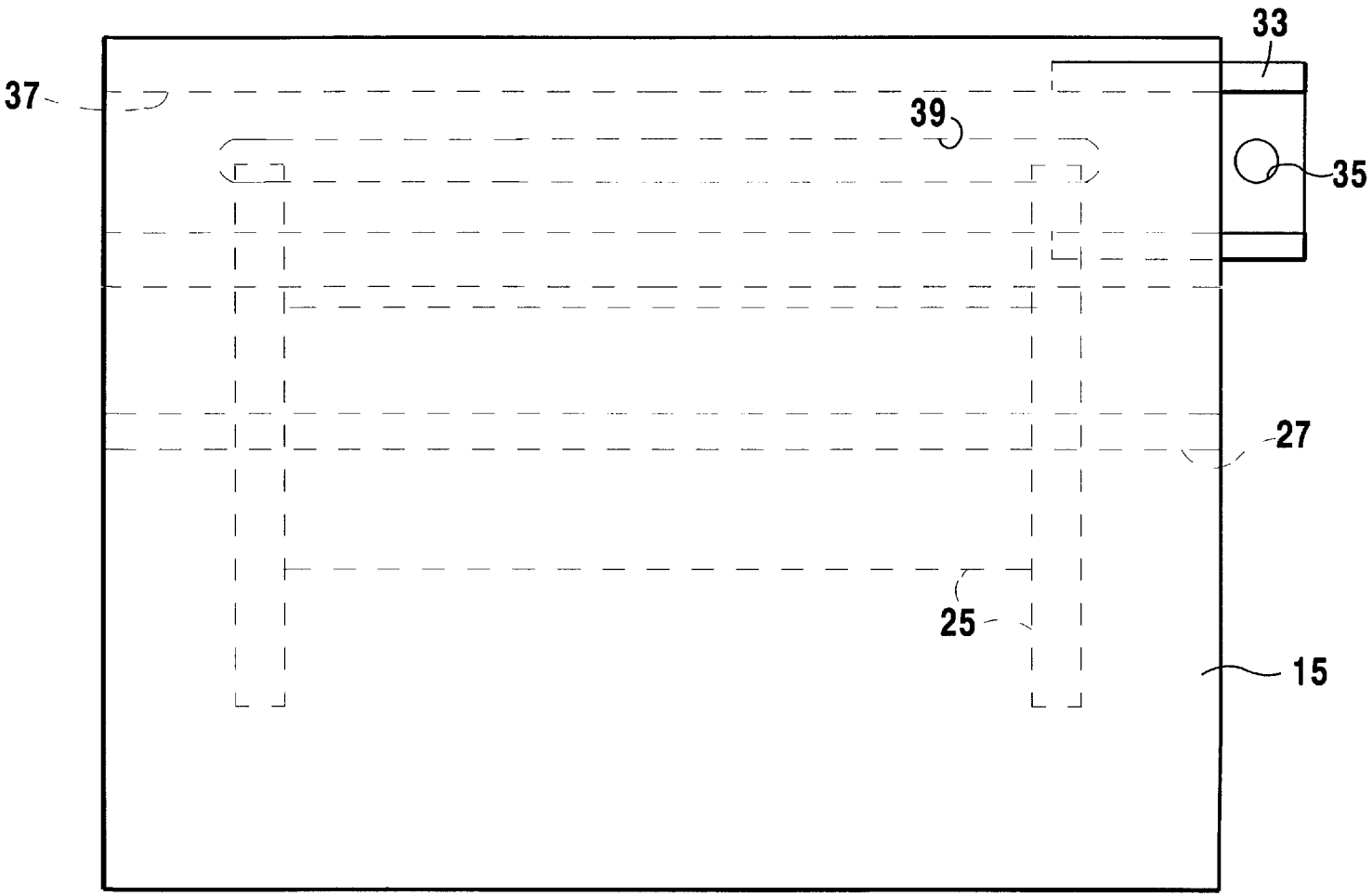
FIG. 5 is a rear elevation of the present invention.

FIG. 5 is a rear elevation of the present invention. Therein is shown the rear side of the housing 15, the horizontally slidable bar 33 having a hole 35 therein along with the track 37 in which the bar 33 is mounted and slides. Also, therein is shown the horizontally elongated hole 39 which provides a passageway through which the line 13 (not shown) can pass. Also shown as hidden lines are the spool assembly 25 and the axle assembly 27.

Figure 6:
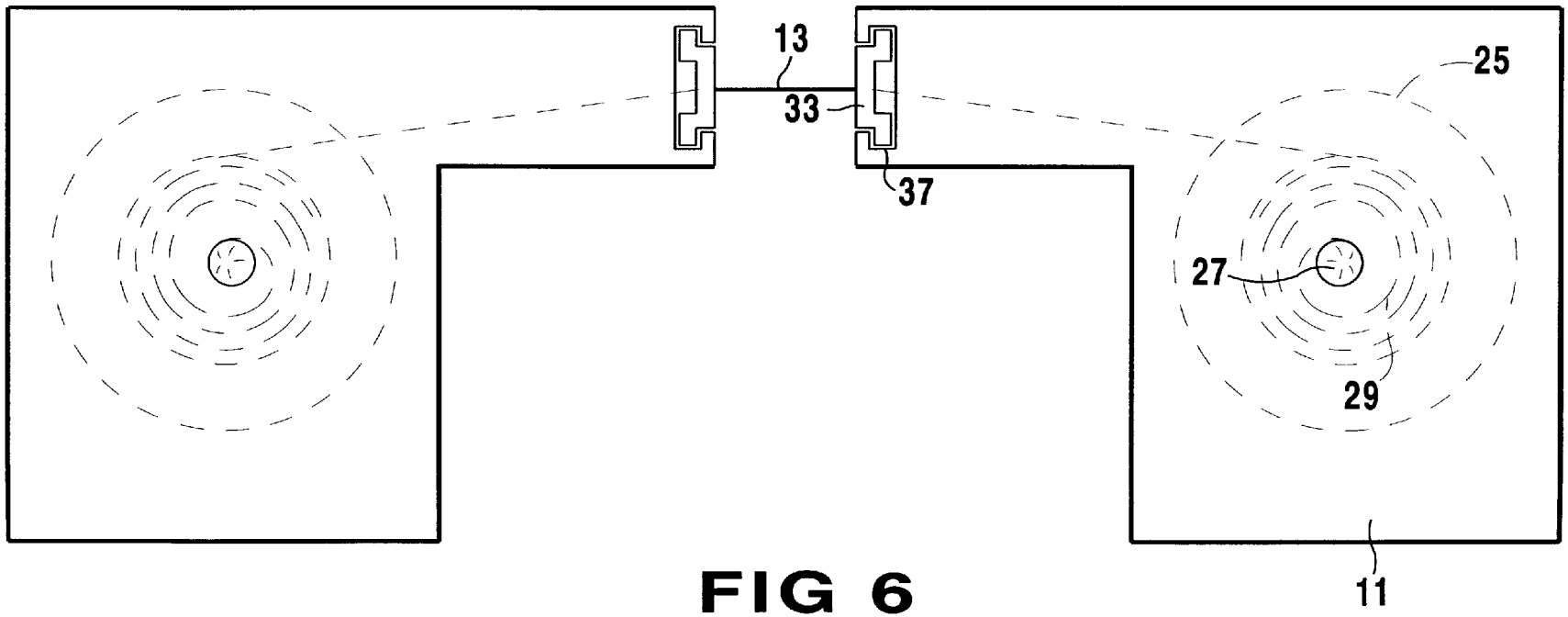
FIG. 6 is a side elevation of the present invention when not in use. Shown in hidden lines are the spring in its relaxed state connecting the axle and the spool, and the string leading to the spool.

FIG. 6 is a side elevation of the present invention as it would appear when not in use. Shown in hidden lines are the spring 29 in its relaxed state connecting to the axle 27 and the spool 25, and the string 13 connecting the two line block assemblies 11 and leading to the spool 25, along with the horizontally slidable bar 33 and the track 37 in which the bar 33 is mounted and slides. It should be noted that the slidable bar 33 is accurately and effectively machined and sized so that it is only slightly smaller than the track 37, so that the bar 33 fits snugly into the track 37 so that the bar 33 will not freely slide due to horizontal pressure from the line.

Figure 7:
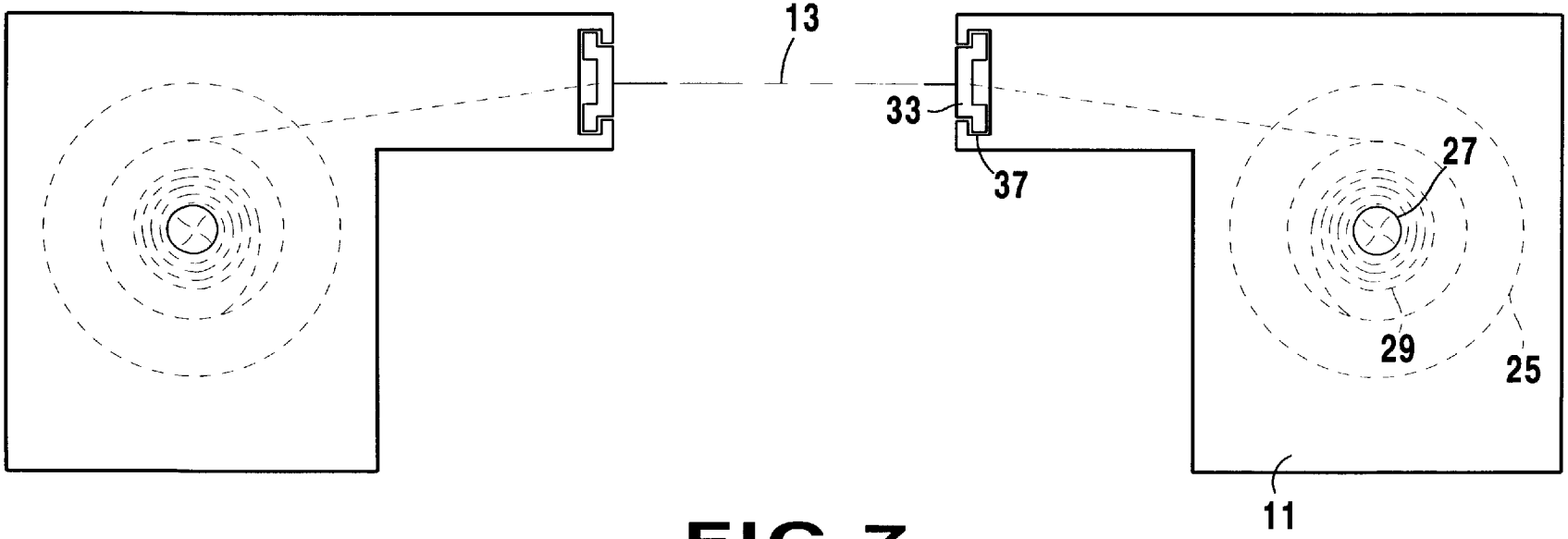
FIG. 7 is a side elevation of the present invention wherein the string line is extended causing the spring to coil tighter and provide the tension that holds the line blocks to the cornerstones.

FIG. 7 is a side elevation of the present invention wherein the string line 13 is extended causing the spring 29 to coil tighter and provide the tension that holds the line blocks 11 to the cornerstones. Shown in hidden lines are the spring 29 in its tensioned state connecting to the axle 27 and the spool 25, and the string 13 connecting the two line block assemblies 11 and leading to the spool 25, along with the horizontally slidable bar 33 and the track 37 in which the bar 33 is mounted and slides.

Figure 8:
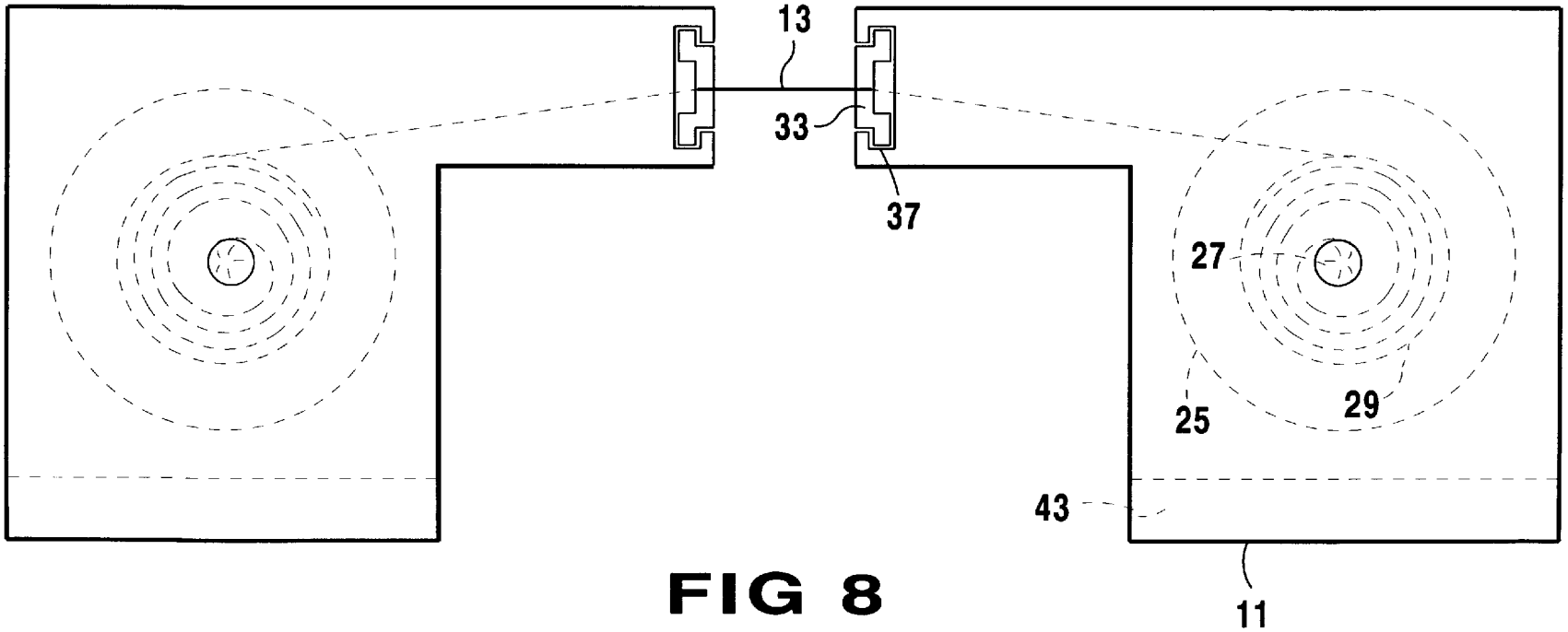
FIG. 8 is an alternate embodiment of the present invention as shown in FIG. 6, wherein a weighted bottom is added to the reel housing to act as ballast to offset the pull of the string on the upper portion of the line block.

FIG. 8 is an alternate embodiment of the present invention as shown in FIG. 6, wherein a weighting means 43 is placed on or about the bottom of the housing 15 whereas weight is added to the reel housing 15 to act as ballast to offset the pull of the string 13 on the upper portion of the line block 11.

It will be understood that each of the elements described above, or two or more together, may also find a useful application in other types of applications differing from the type described above. These include, for example, agricultural, industrial and commercial applications in addition to the residential use discussed herein.

While the invention has been illustrated and described as embodied in a recoiling string line, it is not intended to be limited to the details shown, since it will be understood that various omissions, modifications, substitutions and changes in the forms and details of the mechanism illustrated and in its operation can be made by those skilled in the art without departing in any way from the spirit and scope of the present invention.

Without further analysis, the foregoing will so fully reveal the gist of the present invention that others can, by applying the current knowledge, readily adapt it for various applications without omitting features that, from the standpoint of prior art, fairly constitute essential characteristics of this invention.

What is claimed as new and desired to be protected by Letters Patent is set forth in the appended claims:

I claim:

1. An apparatus for aligning a mason's string, comprising:

a) a pair of string positioning means;

b) means for tensioning said string through cooperation of said string positioning means;

c) means for recoiling said string onto said string positioning means;

d) means for attaching said string positioning means onto a workpiece, and e) a vertically shortened forward wall, said vertically shortened forward wall having a forward facing overhang section positioned above and projecting forward of said vertically shortened forward wall, said overhang section accommodating a horizontally slidable string offset mechanism whereby said string is offset out of the mason's path of work.

2. The apparatus of claim 1, further comprising spring means for tensioning and recoiling said string, and wherein said string is secured between said pair of string positioning means.

3. The apparatus of claim 2, wherein said spring means of said pair of string positioning means cooperate to provide opposing string tension on said pair of string positioning means whereby said pair of said string positioning means are attached to the workpiece.

4. The apparatus of claim 1, further comprising string offset means for positioning said string whereby said string is offset out of the mason's path of work.

5. The apparatus of claim 1, wherein said horizontally slidable string off-set mechanism has a hole therein for accommodation of said string whereby said string is offset out of the mason's path of work.

6. The apparatus of claim 1, wherein said vertically shortened forward wall and said forward facing overhang section cooperate to form a flange whereby said string positioning means is attached to the workpiece.

7. The apparatus of claim 1, further comprising weighting means connected to said means for attaching, and wherein said pair of string positioning means is firmly attached to the workpiece.

8. An apparatus for aligning a mason's string, comprising:

a) a pair of line blocks;

b) a housing for each said line block;

c) a rotatable reel assembly being contained in each housing around which said string is coiled;

d) said reel assemblies cooperating to tension and recoil said string;

e) spring means for rotatably driving said reel assemblies;

f) said housing being attachable to a workpiece; and g) a vertically shortened forward wall, said vertically shortened forward wall having a forward facing overhang section positioned above and projecting forward of said vertically shortened forward wall, said overhang section accommodating a horizontally slidable string offset mechanism whereby said string is offset out of the mason's path of work.

9. The apparatus of claim 8, wherein said spring means cooperate to provide opposing string tension whereby said pair of line blocks are attached to the workpiece.

10. The apparatus of claim 8, further comprising string offset means for positioning said string whereby said string is offset out of the mason's path of work.

11. The apparatus of claim 8, wherein said horizontally slidable string off-set mechanism has a hole therein for accommodation of said string whereby said string is offset out of the mason's path of work.

12. The apparatus of claim 8, further comprising weighting means connected to said means for attaching, and wherein said pair of string positioning means is firmly attached to the workpiece.

13. The apparatus of claim 8, wherein said vertically shortened forward wall and said forward facing overhang section cooperate to form a flange whereby said string positioning means is attached to the workpiece.

* * * * *